US012173965B2

(12) United States Patent
Goodwin et al.

(10) Patent No.: US 12,173,965 B2
(45) Date of Patent: Dec. 24, 2024

(54) HYBRID LOOP HEAT PIPE WITH INTEGRATED MAGNETICALLY LEVITATING BEARINGLESS PUMP

(71) Applicant: The Government of the United States of America, as represented by the Secretary of the Navy, Arlington, VA (US)

(72) Inventors: Gabriel Goodwin, Washington, DC (US); Evan Hyde, Washington, DC (US); Jesse Maxwell, Washington, DC (US); Kwok Cheung, Washington, DC (US); Robert Baldauff, Washington, DC (US); Triem Hoang, Laurel, MD (US)

(73) Assignee: The Government of the United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 17/210,407

(22) Filed: Mar. 23, 2021

(65) Prior Publication Data

US 2021/0302104 A1 Sep. 30, 2021

Related U.S. Application Data

(60) Provisional application No. 62/993,492, filed on Mar. 23, 2020.

(51) Int. Cl.

| | |
|---|---|
| ***F28D 15/02*** | (2006.01) |
| ***F04D 29/058*** | (2006.01) |
| ***F28D 15/04*** | (2006.01) |

(52) U.S. Cl.
CPC ..... *F28D 15/025* (2013.01); *F04D 29/058* (2013.01); *F28D 15/043* (2013.01)

(58) Field of Classification Search
CPC ..... F28D 15/025; F28D 15/04; F28D 15/043; F28D 2015/0291; F16C 32/044
(Continued)

(56) References Cited

U.S. PATENT DOCUMENTS

| | | | | |
|---|---|---|---|---|
| 4,470,450 | A | 9/1984 | Bizzell et al. | |
| 5,103,897 | A * | 4/1992 | Cullimore ..... | B64G 1/50 165/41 |

(Continued)

FOREIGN PATENT DOCUMENTS

| | | | |
|---|---|---|---|
| KR | 20140049675 | A | 4/2014 |
| WO | 91/03688 | A1 | 3/1991 |
| WO | 2019085090 | A1 | 5/2019 |

OTHER PUBLICATIONS

Xiaodong Sun, Long Chen, Zebin Yang, "Overview of Bearingless Induction Motors", Mathematical Problems in Engineering, vol. 2014, Article ID 570161, 10 pages, 2014. https://doi.org/10.1155/2014/570161 (Year: 2014).*

(Continued)

*Primary Examiner* — Tho V Duong
(74) *Attorney, Agent, or Firm* — US Naval Research Laboratory; Nigel R. Fontenot

(57) ABSTRACT

A hybrid capillary and mechanically pumped loop heat pipe (HLHP) includes a fluid loop having an evaporator thermally coupled to a heat load, a condenser thermally coupled to a heat sink, a reservoir, and one or more magnetically levitating pumps configured to pump fluid through the loop thereby improving heat transport capacity and system stability.

3 Claims, 3 Drawing Sheets

(58) Field of Classification Search
USPC ..... 62/510
See application file for complete search history.

(56) References Cited

U.S. PATENT DOCUMENTS

| | | | | |
|---|---|---|---|---|
| 5,178,543 | A * | 1/1993 | Semans | G09B 9/00 434/218 |
| 6,658,861 | B1 * | 12/2003 | Ghoshal | H10N 10/00 257/E23.098 |
| 6,745,830 | B2 | 6/2004 | Dinh | |
| 6,810,946 | B2 | 11/2004 | Hoang | |
| 6,879,074 | B2 | 4/2005 | Amrhein et al. | |
| 6,948,556 | B1 | 9/2005 | Anderson et al. | |
| 6,990,816 | B1 | 1/2006 | Zuo et al. | |
| 8,496,874 | B2 | 6/2013 | Gellman et al. | |
| 2001/0016170 | A1 | 8/2001 | Ozaki et al. | |
| 2003/0136555 | A1 * | 7/2003 | Dinh | F28D 15/0266 165/274 |
| 2005/0139345 | A1 * | 6/2005 | Pokharna | F28F 23/00 257/E23.098 |
| 2008/0217483 | A1 * | 9/2008 | Hugon | B64G 1/503 244/172.6 |
| 2010/0326628 | A1 * | 12/2010 | Campbell | H05K 7/20654 165/185 |
| 2012/0007265 | A1 * | 1/2012 | See | B29C 48/395 264/40.3 |
| 2013/0022481 | A1 | 1/2013 | Schob et al. | |
| 2013/0118710 | A1 * | 5/2013 | Chen | F25D 31/00 165/104.11 |
| 2013/0186121 | A1 * | 7/2013 | Erb | F24F 1/0007 165/104.34 |
| 2014/0069614 | A1 * | 3/2014 | Chiu | H01L 23/473 165/104.19 |
| 2015/0007598 | A1 * | 1/2015 | Choi | F25B 41/24 62/190 |
| 2015/0183404 | A1 * | 7/2015 | Romack | B60S 1/485 239/284.1 |
| 2015/0192368 | A1 * | 7/2015 | Shedd | F25B 41/20 165/96 |
| 2015/0285245 | A1 * | 10/2015 | Weber | F04C 2/107 418/210 |
| 2015/0338171 | A1 | 11/2015 | Torres Sepulveda et al. | |
| 2016/0124474 | A1 * | 5/2016 | So | F28D 15/046 361/679.52 |
| 2016/0131141 | A1 | 5/2016 | Sato et al. | |
| 2017/0268516 | A1 * | 9/2017 | Oppermann | F04D 15/0066 |
| 2018/0231329 | A1 * | 8/2018 | Adamson | F28D 15/04 |
| 2019/0013747 | A1 * | 1/2019 | Barletta | F04D 29/026 |
| 2019/0327856 | A1 * | 10/2019 | Lan | H05K 7/20272 |
| 2019/0356195 | A1 | 11/2019 | Holenstein | |
| 2020/0021166 | A1 | 1/2020 | Nussbaumer et al. | |

OTHER PUBLICATIONS

Holman et al., "Thermal-Fluid Oscillations in a Loop Heat Pipe with Attached Mass", 15th International Energy Conversion Engineering Conference, No. AIAA 2017-4695, Jul. 2017, 12 pages.

English Translation of KR 20140049675 (translation provided by Google Patents), translated Jul. 22, 2024 (4 pages).

Written Opinion of the International Searching Authority in corresponding PCT Application PCT/US2021/023774, mailed Jul. 7, 2021 (3 pages).

International Search Report in corresponding PCT Application PCT/US2021/023774, mailed Jul. 7, 2021 (3 pages).

International Preliminary Report on Patentability in corresponding PCT Application PCT/US2021/023774, Sep. 22, 2022 (4 pages).

Extended European Search Report in related EP Application No. 21775851.5 (National Phase of PCT Application PCT/US2021/023774), Mar. 11, 2024 (7 pages).

* cited by examiner

HYBRID LOOP HEAT PIPE WITH INTEGRATED MAGNETICALLY LEVITATING BEARINGLESS PUMP

RELATED APPLICATIONS

This application claims the benefit of U.S. Provisional Application No. 62/993,492 filed Mar. 23, 2020, which is hereby incorporated herein by reference.

FEDERALLY-SPONSORED RESEARCH AND DEVELOPMENT

The United States Government has ownership rights in this invention. Licensing inquiries may be directed to Office of Technology Transfer, US Naval Research Laboratory, Code 1004, Washington, DC 20375, USA; +1.202.767.7230; techtran@nrl.navy.mil, referencing NC 112841.

FIELD OF INVENTION

The present invention relates generally to fluid cooling loops, and more particularly to a hybrid loop heat pipe with a magnetically levitating pump.

BACKGROUND

As the electronics systems aboard air and spacecraft grow in scale and complexity, so too does the heat generated by those systems. A high-heat flux, compact, maintenance-free cooling system is required to meet the increased demand for heat removal.

SUMMARY OF INVENTION

Loop heat pipes are robust and effective thermal management systems that are long-life and maintenance-free, making them ideal for use in unmanned spacecraft. Integrating a mechanical pump into a LHP system can drastically improve the system's heat transport capacity through increased mass flowrate of the working fluid. Like LHP, maglev bearingless pumps are also maintenance-free, which is a necessity in the space environment.

In the absence of a mechanical pump, a LHP is a passive device consisting of an evaporator with an attached reservoir and a heat exchanger, as shown in FIG. 1. This conventional LHP design relies upon the capillary action developed in the porous wick of the evaporator to generate a pressure head in the loop and drive the working fluid through the system. A heat load is applied to the external surface of the evaporator, causing the liquid at the outer edge of the porous wick to evaporate and to draw new liquid through the porous wick to the outer edge of the wick in a continuous cycle. The vapor flows out of the evaporator to a condenser, where the vapor condenses to liquid before flowing back into the evaporator. This passive heat transport cycle continues indefinitely, as long as sufficient heat load is applied to the evaporator to result in a phase change of the working fluid. A reservoir is included in the system to allow for liquid expansion at the maximum operating temperature. A secondary wick connects the reservoir to the primary wick in the evaporator, ensuring that the primary wick can always draw fluid. The maximum mass flowrate through the traditional LHP, and therefore the heat transport capacity, is limited by the pressure head generated by the capillary action in the evaporator, which is a function of the evaporator design and the applied heat load.

Traditional LHP systems are also subject to transient dynamics, particularly during start-up, that can cause the heat transported by the loop to cycle undesirably, or even for blockages to develop in the loop resulting in failure of the system entirely. Integrating a maintenance-free, bearingless mechanical pump into the LHP system is proposed to mitigate these limitations. Finally, despite existing designs for heat pipe systems that are augmented with mechanical pumps, the additional step of and benefits achieved through utilization of a maglev bearingless mechanical pump have never been considered in the prior-art.

Integrating a magnetically levitating (maglev) bearingless pump in a loop heat pipe (LHP) augments the pressure head generated in the LHP, and thereby increase the mass flowrate through the system and its heat transport capacity, without compromising the LHP system requirement of long-life, maintenance-free operation on manned or unmanned aircraft and spacecraft. A LHP augmented with a maglev bearingless mechanical pump(s) is hereafter referred to as a hybrid loop heat pipe (HLHP).

According to one aspect of the invention a hybrid capillary and mechanically pumped loop heat pipe (HLHP) includes a fluid loop having, an evaporator thermally coupled to a heat load, a condenser thermally coupled to a heat sink, a reservoir, and one or more magnetically levitating pumps configured to pump fluid through the loop thereby improving heat transport capacity and system stability without compromising maintenance-free, long life operation of a conventional loop heat pipe.

Optionally, the one or more magnetically levitating pumps are two or more pumps fluidly connected in series, thereby providing additional pressure, variable operating regimes, and improved reliability through redundancy.

Optionally, the HLHP includes a processor configured to selectively operate the one or more magnetically levitating pumps to minimize dynamic oscillations in mass flowrate through the loop.

The foregoing and other features of the invention are hereinafter described in greater detail with reference to the accompanying drawings.

DETAILED DESCRIPTION

Figure 1:
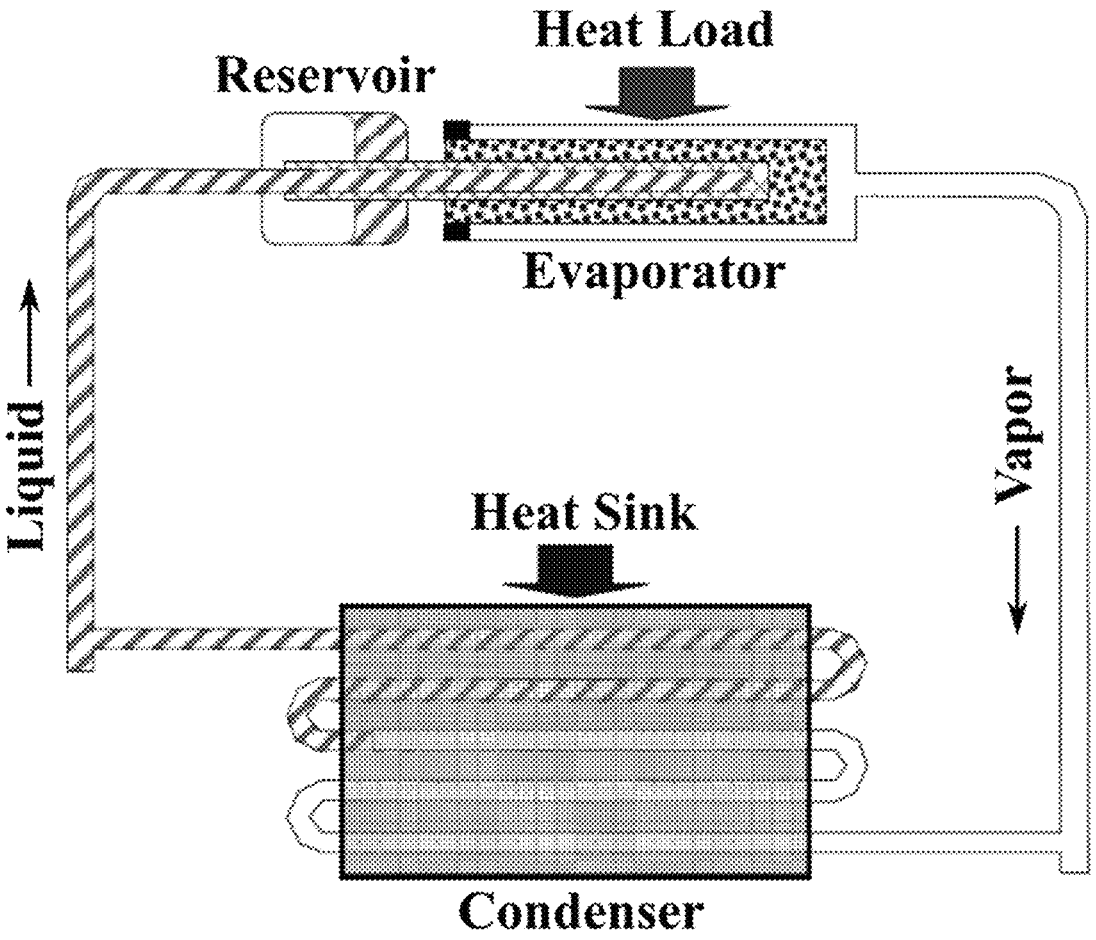
FIG. 1 shows a schematic of a capillary-pumped loop heat pipe.
Figure 2:
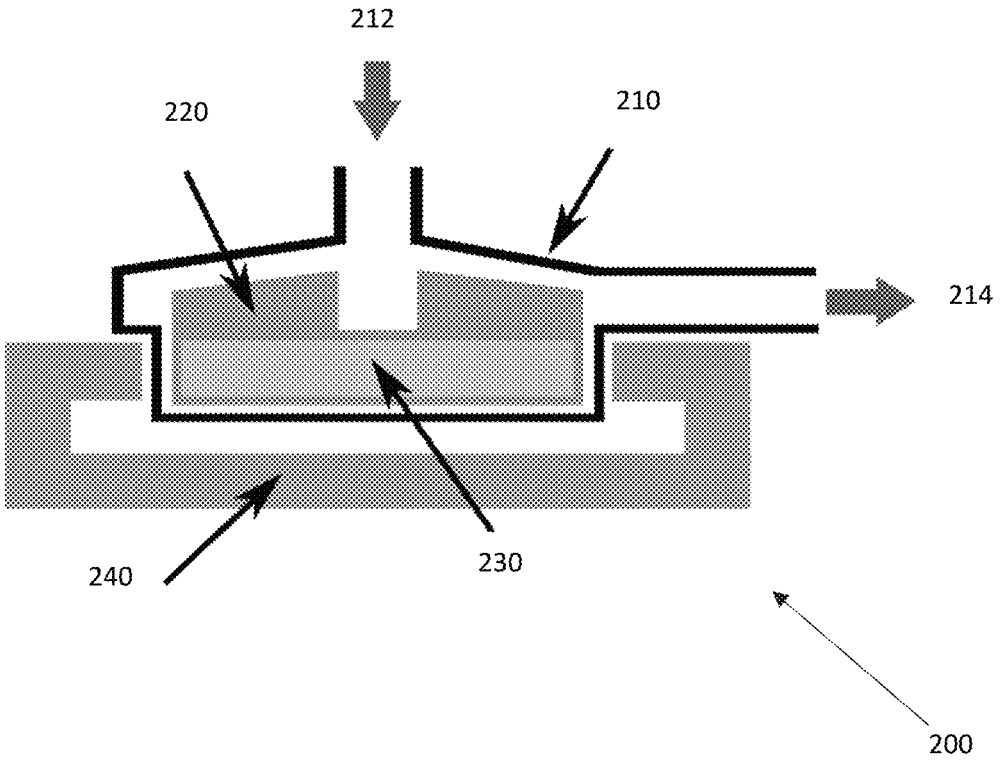
FIG. 2 shows a simplified schematic of a maglev bearingless pump.

FIG. 2 shows a simplified schematic of a maglev bearingless pump 200. The working fluid flows into the pump casing 210 through the inlet 212, is accelerated by the impeller 220, and exits the pump casing 210 through the outlet 214 at a higher static pressure than at the inlet 212. A permanent magnet 230 is embedded in the impeller. The stator 240 surrounding the pump casing 210 generates a magnetic field which acts to both levitate the embedded impeller magnet at a desired position in the pump casing and cause the impeller to revolve at a prescribed rate.

The advantage to using such a pump as opposed to a traditional positive displacement or centrifugal pump is that there is no driving shaft between the motor and the impeller, so no maintenance-intensive bearing assembly is required. Bearing assemblies are often the first component of mechanical pumps to fail and require replacement. As such, in a maglev bearingless pump the primary pump failure mode is mitigated. Additionally, no residue is produced through mechanical wear of the bearing, shaft, and seal that could clog the sub-micron pores in the evaporator of the LHP. There is also no bearing lubricant that could contaminate the LHP. Since there is no shaft connecting the pump impeller with the driving mechanism, the pump and LHP can be hermetically sealed against the surrounding environment, preventing contaminants from entering the loop.

Magnetically levitating bearingless pumps have previously been used to pump blood, as they do not contaminate the fluid being pumped with particulate or lubricant. Other applications include the semiconductor industry, where it is crucial that no metal particulate enter the pumped fluid because metal ions could change the semiconductor properties.

Figure 3:
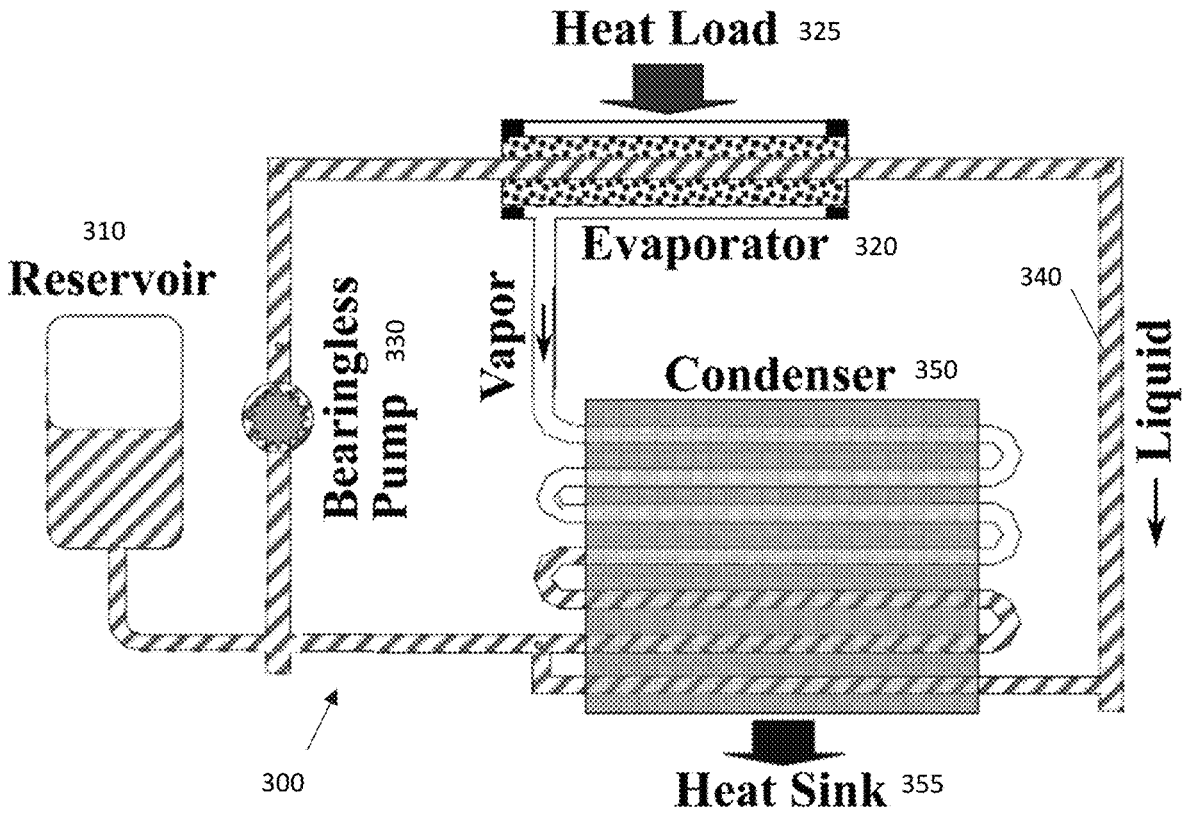
FIG. 3 shows a schematic of an exemplary hybrid loop heat pipe with an integrated bearingless pump.

In a HLHP, the total heat transport capacity of the system is improved through the increased pressure head and mass flowrate achieved through the addition of a mechanical pump. FIG. 3 is a schematic showing the major components of a HLHP 300. In this configuration, the reservoir 310 is not attached to the evaporator 320 (thermally coupled to a heat load 325) as it is in a traditional LHP. The evaporator in a HLHP is designed such that liquid can flow through and exit without changing phase. This is necessary because the mass flowrate through the loop with the mechanical pump 330 operating may, under some heat loads, be in excess of the mass flowrate of liquid that can be vaporized within the evaporator. Excess liquid flows through the evaporator 320 and is routed to the liquid return line 340. The maglev bearingless pump 330 is installed on the liquid return line, downstream of the condenser 350 (thermally coupled to a heat sink 355) and reservoir 310 and upstream of the evaporator 320.

Figure 4:
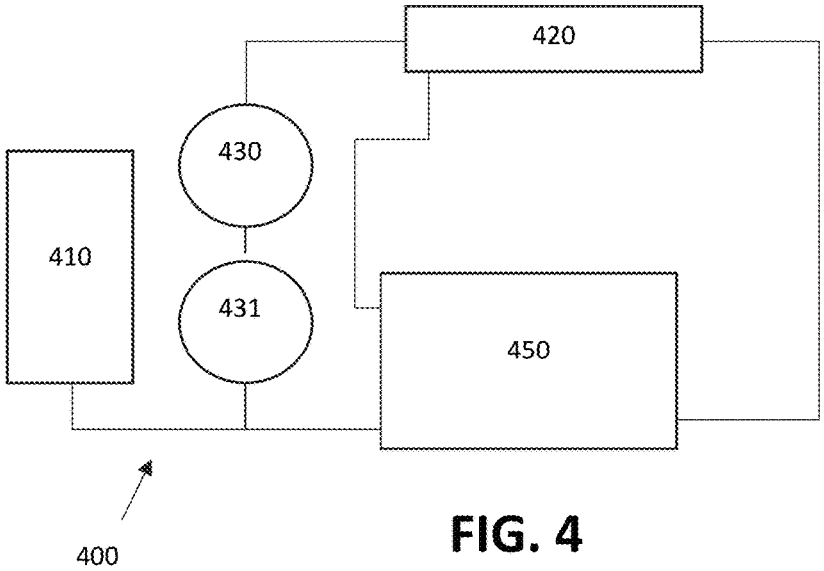
FIG. 4 shows a schematic of an exemplary hybrid loop heat pipe with two integrated bearingless pumps in series.

Turning now to FIG. 4, an exemplary embodiment of the HLHP is shown at 400. The HLHP 400 is substantially the same as the above-referenced HLHP 300, and consequently the same reference numerals but indexed by 100 are used to denote structures corresponding to similar structures in the HLHP 300. In addition, the foregoing description of the HLHP 300 is equally applicable to the HLHP 400 except as noted below. Moreover, it will be appreciated upon reading and understanding the specification that aspects of the HLHPs may be substituted for one another or used in conjunction with one another where applicable.

FIG. 4 shows a schematic of an exemplary system 400 having two pumps 430, 431. The pumps are integrated into the HLHP, with the ability to operate the system using one, both, or neither pumps. When the pumps are not running, the system is said to be running in traditional LHP mode, where the pumps are not powered and are bypassed by the liquid return.

Both the evaporator and heat exchanger may be sized to accommodate heat loads of up to 5 KW, e.g. The wick in the evaporator may be fabricated of sintered nickel with 1.2 μm pores (35% porosity), with a 0.5 in. outside diameter and length of 18 in.

One significant advantage to the integration of a maglev bearingless pump into a HLHP is the increased heat transport capacity, as compared to that of a traditional LHP, without compromising the long-life, maintenance-free operation that is one of the most desirable attributes of a traditional LHP for spacecraft and aircraft applications. An exemplary working fluid is anhydrous liquid ammonia, which is, in many cases, the most desirable for space applications due to its low freezing point and high latent heat of vaporization.

Another advantage provided when operating in HLHP mode is the diminished oscillations observed in the total mass flowrate through the loop. Oscillations in mass flowrate through the evaporator are undesirable for steady system operation. The oscillations occur in a capillary-pumped LHP due to complex thermal-fluid interactions in the LHP system; understanding the underlying physics of these interactions is an active field of research. In the HLHP operating mode, however, the mass flowrate oscillations are significantly diminished or non-existent, due to the mechanical pump providing stable mass flowrate through the system at all times. Additionally, the integration of the bearingless pump does not compromise the long-life operation of the HLHP.

Although the embodiments described herein involve running a single maglev bearingless pump, more than one pump is possible, and is ddesireable in certain circumstances. Multiple pumps installed in series have two main advantages associated with this arrangement. The first is that when both pumps are running, the pressure head and mass flowrate in the loop increase, resulting in an accompanying increase in the heat transport capability of the system. In tests when two pumps were running at the same rate, the pressure head in the loop is doubled as compared to operating only a single pump, while mass flowrate increases by a factor of 1.4. An additional benefit to integrating multiple pumps in series is the increase in system reliability afforded by backup pumps. For instance, if a system is designed such that only a single pump is required to accommodate the maximum expected heat load and three pumps are installed in the system in series, then two of those pumps can fail while the system continues to operate as designed.

In a simplified HLHP control system, the heat load applied to the evaporator would govern whether one or multiple pumps were powered. If the heat load increases to the point where a single pump cannot provide sufficient mass flowrate through the evaporator to prevent dry out of the primary wick, the external evaporator temperature would begin to increase in the same manner as for unstable operation on an LHP. At the earliest detection of this increase in temperature, a second pump would then be powered on to provide the additional mass flowrate required, and so on with multiple pumps until a stable evaporator temperature was maintained for the given heat load.

Any representative processing functions described herein can be implemented using computer processors, computer logic, application specific integrated circuits (ASIC), digital signal processors, etc., as will be understood by those skilled in the art based on the discussion given herein. Accordingly, any processor that performs the processing functions described herein is within the scope and spirit of the present disclosure.

The above systems and methods may be implemented as a computer program executing on a machine, as a computer program product, or as a tangible and/or non-transitory computer-readable medium having stored instructions. For example, the functions described herein could be embodied by computer program instructions that are executed by a computer processor or any one of the hardware devices listed above. The computer program instructions cause the processor to perform the signal processing functions described herein. The computer program instructions (e.g., software) can be stored in a tangible non-transitory computer usable medium, computer program medium, or any storage medium that can be accessed by a computer or processor. Such media include a memory device such as a RAM or ROM, or other type of computer storage medium such as a computer disk or CD ROM. Accordingly, any tangible non-transitory computer storage medium having computer program code that cause a processor to perform the signal processing functions described herein are within the scope and spirit of the present disclosure.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A hybrid capillary and mechanically pumped loop heat pipe (HLHP) comprising:

a fluid loop having an evaporator thermally coupled to a heat load, the evaporator being configured to allow excess fluid to flow through the evaporator and exit without changing phase and the excess fluid is routed to a liquid return line, a condenser thermally coupled to a heat sink, a reservoir, and first and second magnetically levitating bearingless pumps configured to pump fluid through the loop, wherein the first and second magnetically levitating bearingless pumps are configured to run at a same rate and to produce, when running at the same rate: (i) a doubled value in pressure head compared to a single magnetically levitating bearingless pump, and (ii) a less than doubled increase in mass flowrate in the fluid loop compared to a single magnetically levitating bearingless pump, wherein the less than doubled increase in mass flow rate in the fluid loop comprises an increase by a factor of 1.4.

2. The HLHP of claim 1, wherein the first and second magnetically levitating bearingless pumps are fluidly connected in series.

3. The HLHP of claim 1, further comprising a processor configured to selectively operate the first and second magnetically levitating bearingless pumps to minimize dynamic oscillations in mass flowrate through the loop.

* * * * *